US011970349B2

(12) United States Patent
Tanaka et al.

(10) Patent No.: US 11,970,349 B2
(45) Date of Patent: Apr. 30, 2024

(54) CASSETTE AND PRINTING APPARATUS

(71) Applicant: CANON KABUSHIKI KAISHA, Tokyo (JP)

(72) Inventors: Gakushi Tanaka, Kanagawa (JP); Akira Nakashima, Kanagawa (JP); Kazuto Ishihara, Kanagawa (JP); Yasuhito Tsubakimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 17/874,743

(22) Filed: Jul. 27, 2022

(65) Prior Publication Data

US 2023/0060034 A1 Feb. 23, 2023

(30) Foreign Application Priority Data

Aug. 18, 2021 (JP) ..... 2021-133673

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2402/44* (2013.01); *B65H 2404/74* (2013.01)

(58) Field of Classification Search
CPC . B65H 1/04; B65H 1/26; B65H 1/266; B65H 2402/44; B65H 2402/441; B65H 2404/74
See application file for complete search history.

(56) References Cited

U.S. PATENT DOCUMENTS 7,277,199 B2 * 10/2007 Swayze ..... B41J 13/103 271/162
7,322,763 B2 * 1/2008 Yang ..... B65H 1/266 271/145

(Continued)

FOREIGN PATENT DOCUMENTS

JP H05-024345 2/1993
JP 2007-145551 6/2007

(Continued)

OTHER PUBLICATIONS

Office Action dated Jun. 26, 2023 in counterpart Japanese Application No. 2021-133673, together with English translation thereof.

*Primary Examiner* — Leslie A Nicholson, III
(74) *Attorney, Agent, or Firm* — Venable LLP

(57) ABSTRACT

A cassette comprises a sheet housing portion that has an opening in an upper face and houses sheets, a cassette cover that can be attached and detached and covers at least a portion of the opening, a first protruding portion that is provided in one edge portion of the cassette cover and protrudes toward a bottom face of the sheet housing portion, and a second protruding portion that is provided in the other edge portion of the cassette cover and opposes the first protruding portion, wherein the sheet housing portion includes a projection-shaped portion that protrudes toward the first protruding portion and a position regulating portion that has a gap into which the second protruding portion enters, and the first protruding portion is provided with a receiving portion into which the projection-shaped portion enters.

15 Claims, 11 Drawing Sheets

(56) References Cited

U.S. PATENT DOCUMENTS

| | | | | |
|---|---|---|---|---|
| 7,481,425 | B2 * | 1/2009 | Chikumoto | B65H 1/04 271/145 |
| 7,862,037 | B2 * | 1/2011 | Kunioka | B65H 1/266 271/171 |
| 8,746,684 | B2 * | 6/2014 | Okano | B65H 1/266 271/145 |
| 11,001,463 | B2 * | 5/2021 | Yaginuma | B65H 1/04 |
| 2016/0147188 | A1 | 5/2016 | Yamamoto | G03G 15/6511 |
| 2020/0316972 | A1 | 10/2020 | Umehara et al. | B41J 29/02 |
| 2020/0322493 | A1 | 10/2020 | Ota et al. | H04N 1/00 |
| 2022/0111671 | A1 | 4/2022 | Tokuyama et al. | B41J 29/02 |
| 2022/0258504 | A1 | 8/2022 | Kagami et al. | B41J 29/13 |
| 2022/0260950 | A1 | 8/2022 | Fujibayashi et al. | G03G 21/16 |
| 2022/0263960 | A1 | 8/2022 | Nakashima et al. | H04N 1/00 |

FOREIGN PATENT DOCUMENTS

| | | |
|---|---|---|
| JP | 2015-187037 | 10/2015 |
| JP | 2016-098085 | 5/2016 |
| JP | 2017-132630 | 8/2017 |
| JP | 2017-149503 | 8/2017 |

* cited by examiner

CASSETTE AND PRINTING APPARATUS

BACKGROUND OF THE INVENTION

Field of the Invention

The present invention relates to a cassette used in a printer and the like.

Description of the Related Art

Heretofore, in image forming apparatuses, a system has been widely adopted in which printing sheets are housed in a sheet feed cassette that is attachable and detachable, and sheets are supplied to the inside of the image forming apparatus from this sheet feed cassette. When sheets in the sheet feed cassette are refilled or replaced to sheets of a different size, the sheet feed cassette is drawn out from the image forming apparatus main body, and sheet refilling and replacing operations are performed. In this type of sheet feed cassette, a cassette cover is attached, in many cases, to an upper side of a portion exposed from the main body of the image forming apparatus, in order to prevent water from being contained in sheets, and to prevent foreign matter from dropping on sheets and mixing therein. In this case, the cassette cover may be provided with a positioning mechanism for positioning when installing to the sheet feed cassette. Also, in order to prevent a cassette cover from falling out when the image forming apparatus is transported, the cassette cover may be provided with a mechanism for being retained by the sheet feed cassette.

In Japanese Patent Laid-Open No. 2015-187037, a sheet feed cassette is disclosed in which a cassette cover is provided with a projection and a pivot support portion. In this sheet feed cassette, the cassette cover can be opened and closed relative to the sheet feed cassette by the cassette cover rotating about the pivot support portion.

However, the cassette cover is a component that a user holds by his/her hand when attachment and detachment is performed, and therefore the risk that the user will drop the cassette cover on a floor and the like is higher than that of the sheet feed cassette or the like. In the structure described in Japanese Patent Laid-Open No. 2015-187037, the projection and the pivot support portion are provided in the cassette cover, and therefore there is a problem in that when a user accidentally drops the cassette cover, the risk that the projection and the pivot support portion will be damaged is high.

SUMMARY OF THE INVENTION

The present invention has been made in view of the problems described above, and provides a cassette in which a cassette cover can be prevented from being damaged.

According to a first aspect of the present invention, there is provided a cassette comprising: a sheet housing portion that has an opening in an upper face and houses sheets; a cassette cover that can be attached and detached and covers at least a portion of the opening; a first protruding portion that is provided in one edge portion of the cassette cover and protrudes toward a bottom face of the sheet housing portion; and a second protruding portion that is provided in the other edge portion of the cassette cover and opposes the first protruding portion, wherein the sheet housing portion includes a projection-shaped portion that protrudes toward the first protruding portion and a position regulating portion that has a gap into which the second protruding portion enters, and the first protruding portion is provided with a receiving portion into which the projection-shaped portion enters.

According to a second aspect of the present invention, there is provided a printing apparatus to which the cassette described above is attachable.

Further features of the present invention will become apparent from the following description of exemplary embodiments with reference to the attached drawings.

DESCRIPTION OF THE EMBODIMENTS

Figure 1:
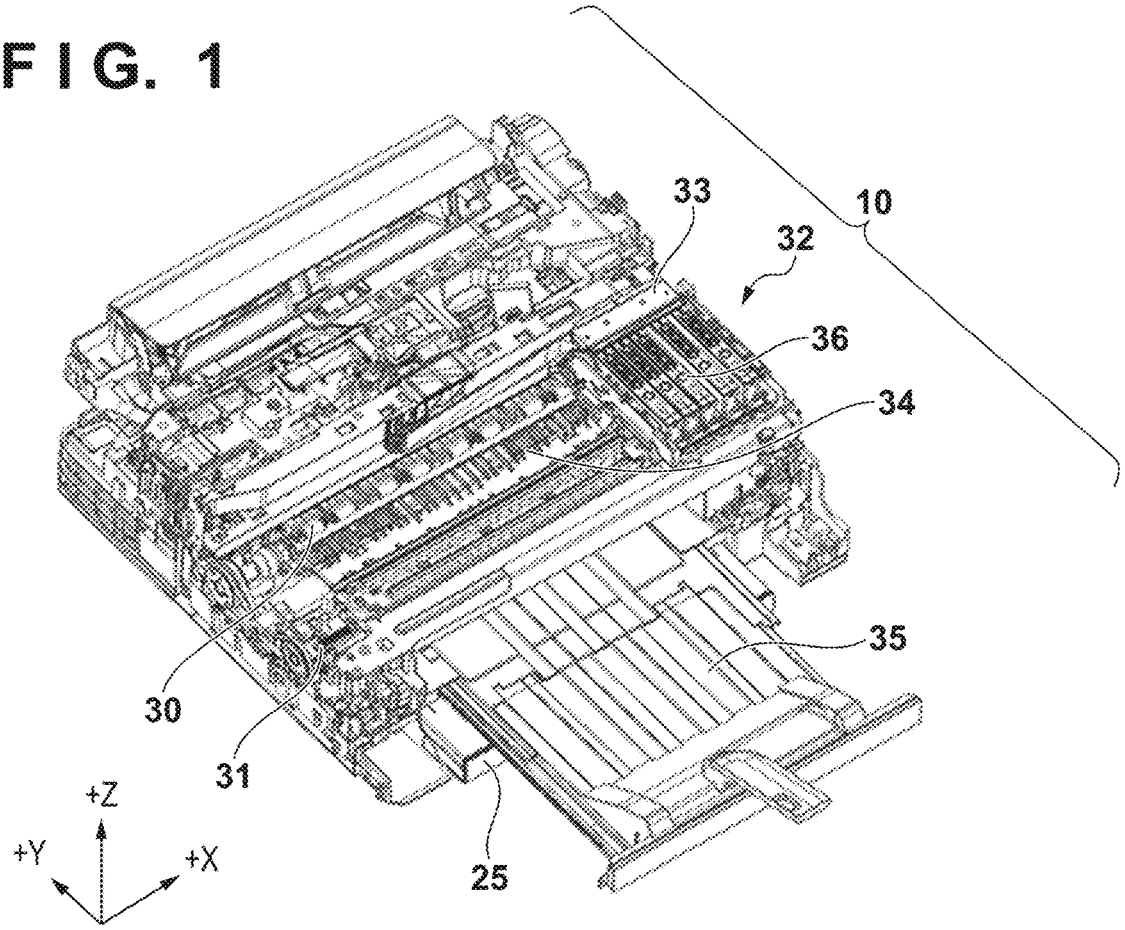
FIG. 1 is a perspective view of an ink jet printing apparatus to which a sheet feed cassette according to one embodiment of the present invention can be applied.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

Figure 2:
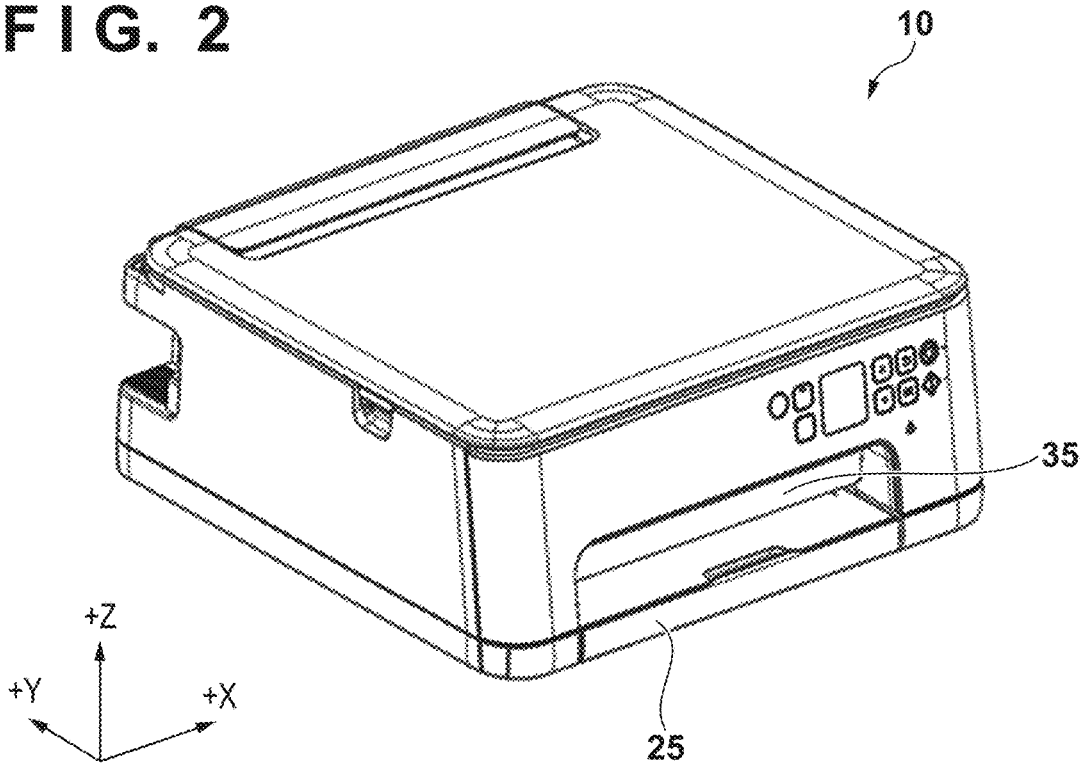
FIG. 2 is a perspective view illustrating an exterior appearance of the ink jet printing apparatus.

FIGS. 1 and 2 are perspective view illustrating an ink jet printing apparatus 10 to which a sheet feed cassette according to one embodiment of the present invention can be applied.

The ink jet printing apparatus 10 is provided with a sheet feed cassette 25 in which sheets are stacked. Topmost one sheet of the sheets inside the sheet feed cassette 25 is separated in a +Y direction by a separation portion (not shown), and is fed to a conveyance portion 30 via a feeding mechanism and a feeding path (not shown). The fed sheet is conveyed in a −Y direction so as to pass an image forming unit 32 by the conveyance portion 30 and a sheet discharge portion 31 that is driven in synchronization with the conveyance portion 30.

The image forming unit 32 that is located between the conveyance portion 30 and the sheet discharge portion 31 is provided with a carriage 33 on which a printing head (not shown) is mounted and that moves back and forth in a direction orthogonal to the conveyance direction of sheets. The printing head receives supply of ink from an ink cartridge 36 that contains ink and print an image by discharging ink on a sheet based on print information. A platen 34 for guiding and supporting sheets, when images are printed, is arranged at a position opposing the image forming unit 32 in the gravity direction. The sheets on which images are printed are discharged to a sheet discharge tray 35 that is provided so as to be movable to the outside of the main body of the printing apparatus via the sheet discharge portion 31.

Figure 3:
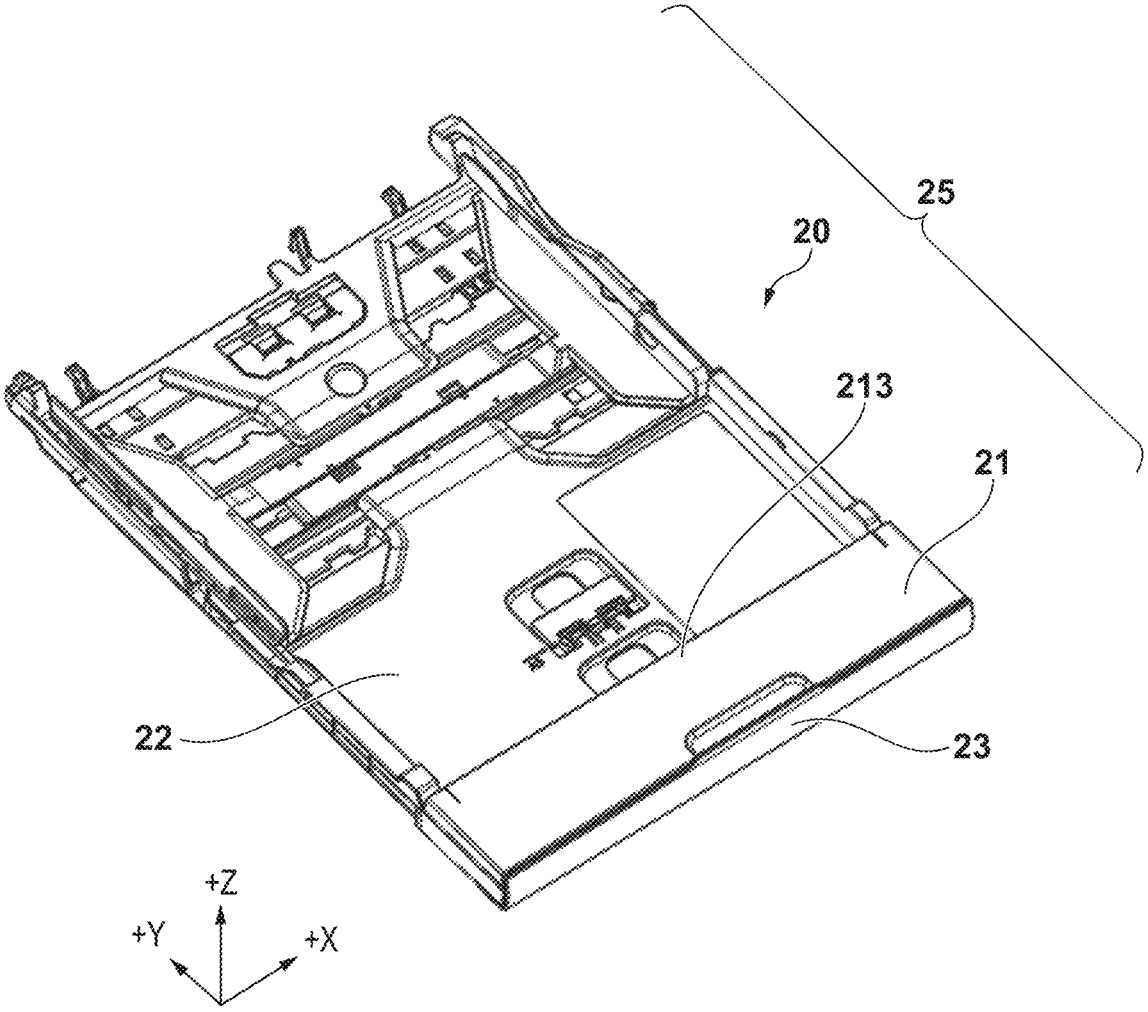
FIG. 3 is a perspective view of a sheet feed cassette and a cassette cover.

FIG. 3 is a perspective view of the sheet feed cassette 25 in the present embodiment.

The sheet feed cassette 25 is constituted by a sheet feed cassette body (sheet housing portion) 20 and a cassette cover 21 that covers at least a portion of the opening of the cassette main body 20. Sheets are housed inside the sheet feed cassette body 20. The sheet feed cassette body 20 can be attached to and detached from the ink jet printing apparatus 10. When sheets are refilled or replaced to sheets of a different size, the sheet feed cassette body 20 is drawn out, in the —Y direction, from the ink jet printing apparatus 10, and sheet refilling and replacing operations are performed.

A cassette cover 21 is attached to an upper side of a portion, of the sheet feed cassette body 20, that is to be exposed from the ink jet printing apparatus 10, in order to prevent water from being contained in sheets, and to prevent foreign matter from dropping on sheets and mixing therein. In order to prevent the cassette cover 21 from falling out from the sheet feed cassette body 20 when the ink jet printing apparatus 10 is moved, the cassette cover 21 is provided with a mechanism for being retained by the sheet feed cassette body 20.

Figure 4A:
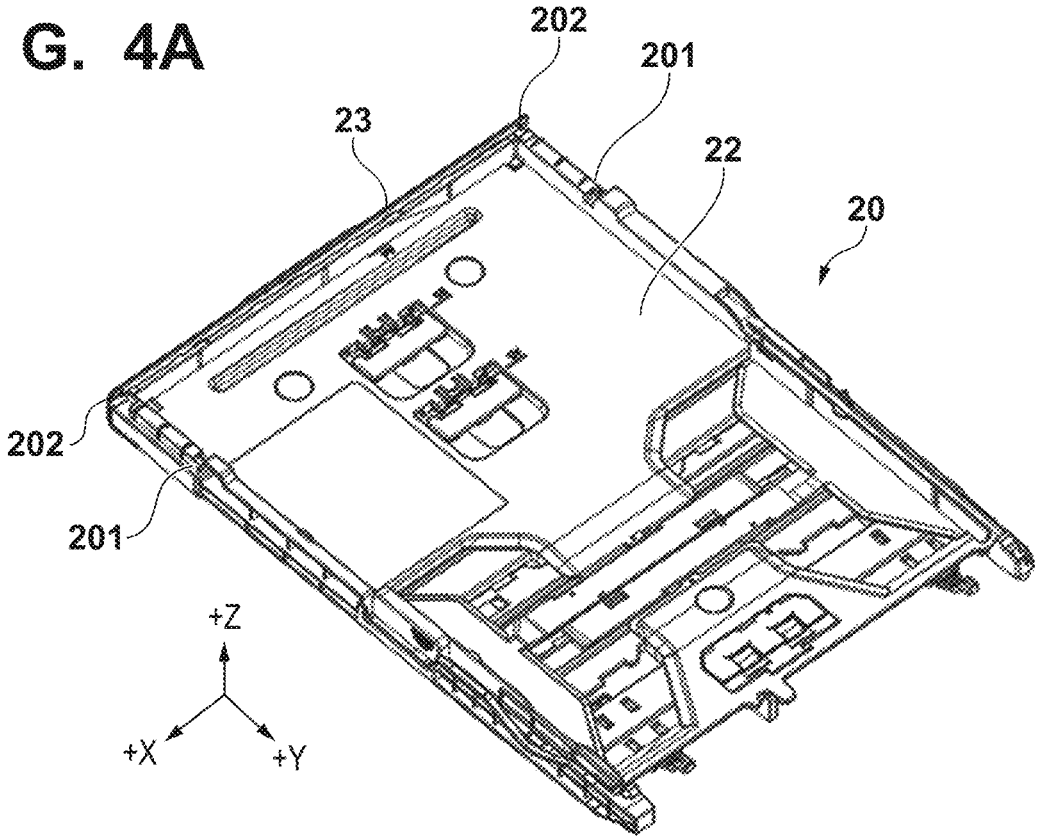
FIGS. 4A and 4B are a perspective view and a partial detail view of the sheet feed cassette.
Figure 4B:
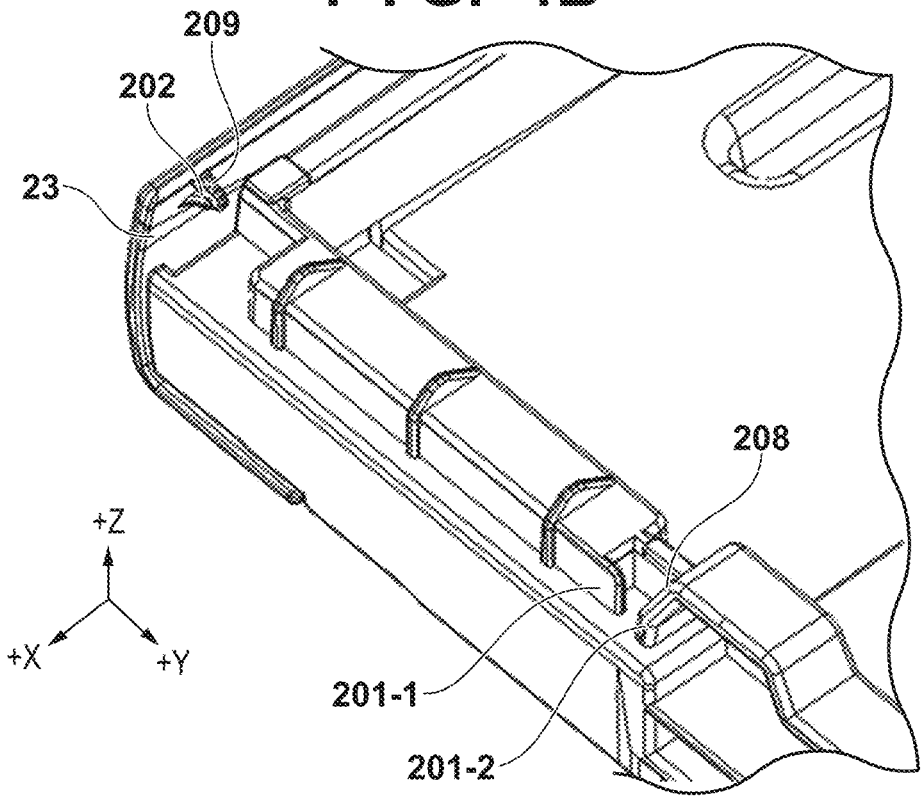
Figure 5A:
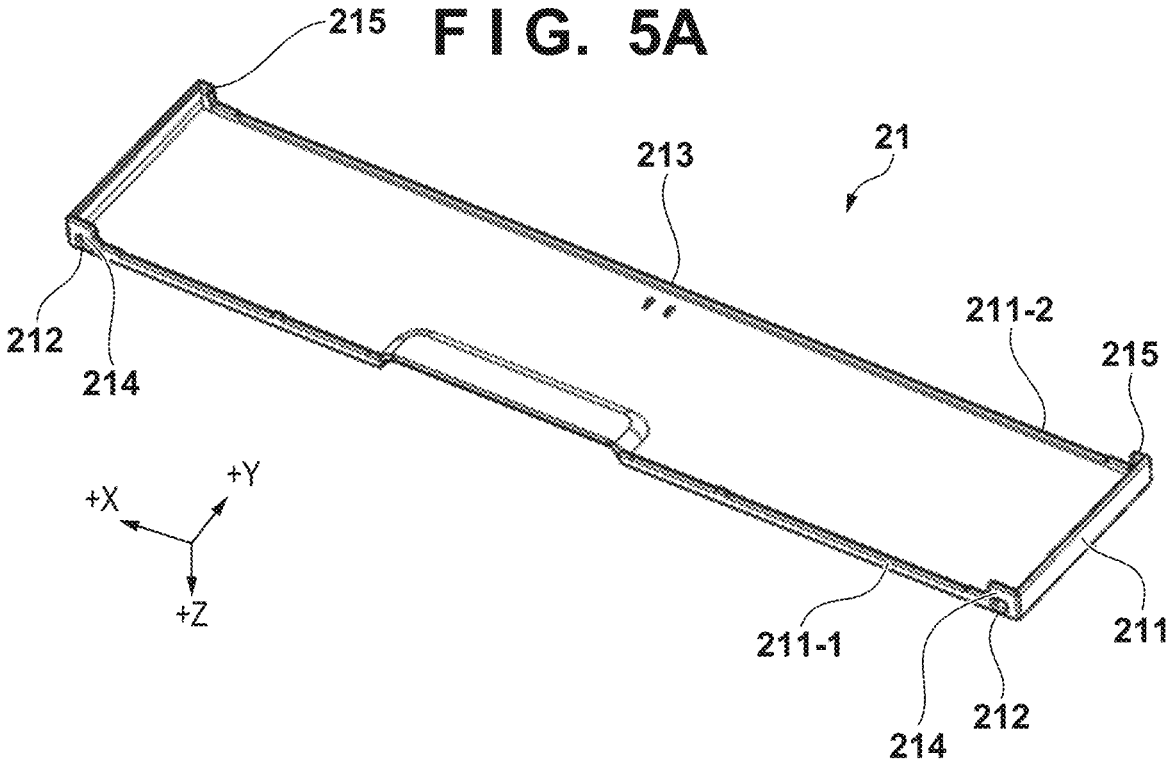
FIGS. 5A and 5B are a perspective view and a partial detail view of the cassette cover.
Figure 5B:
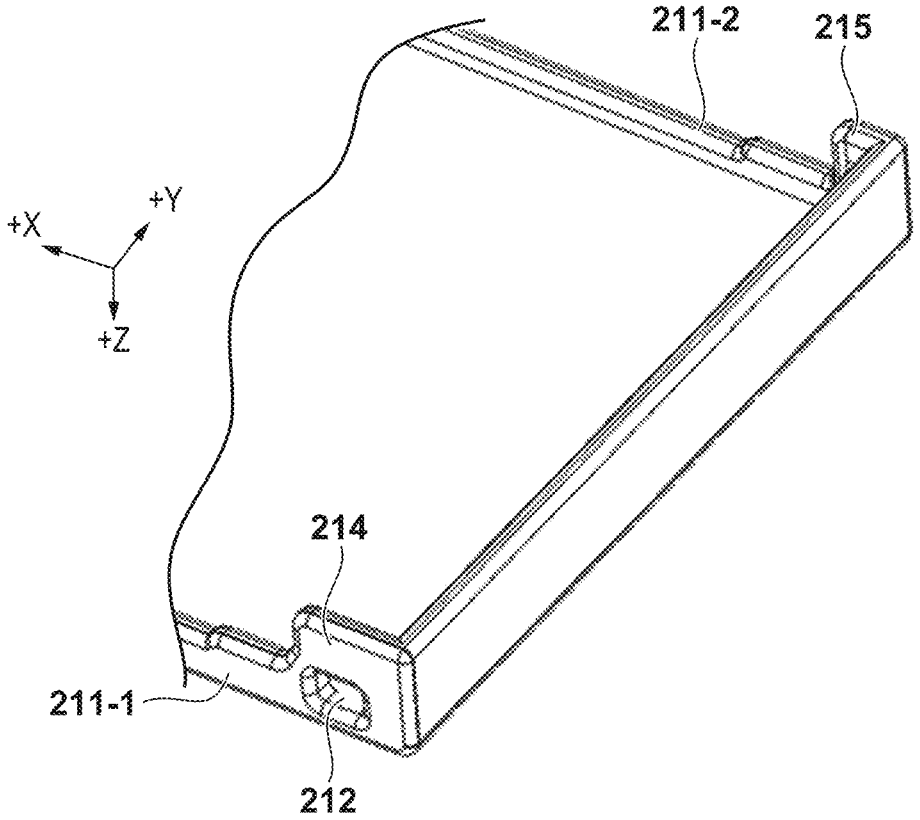
Figure 6:
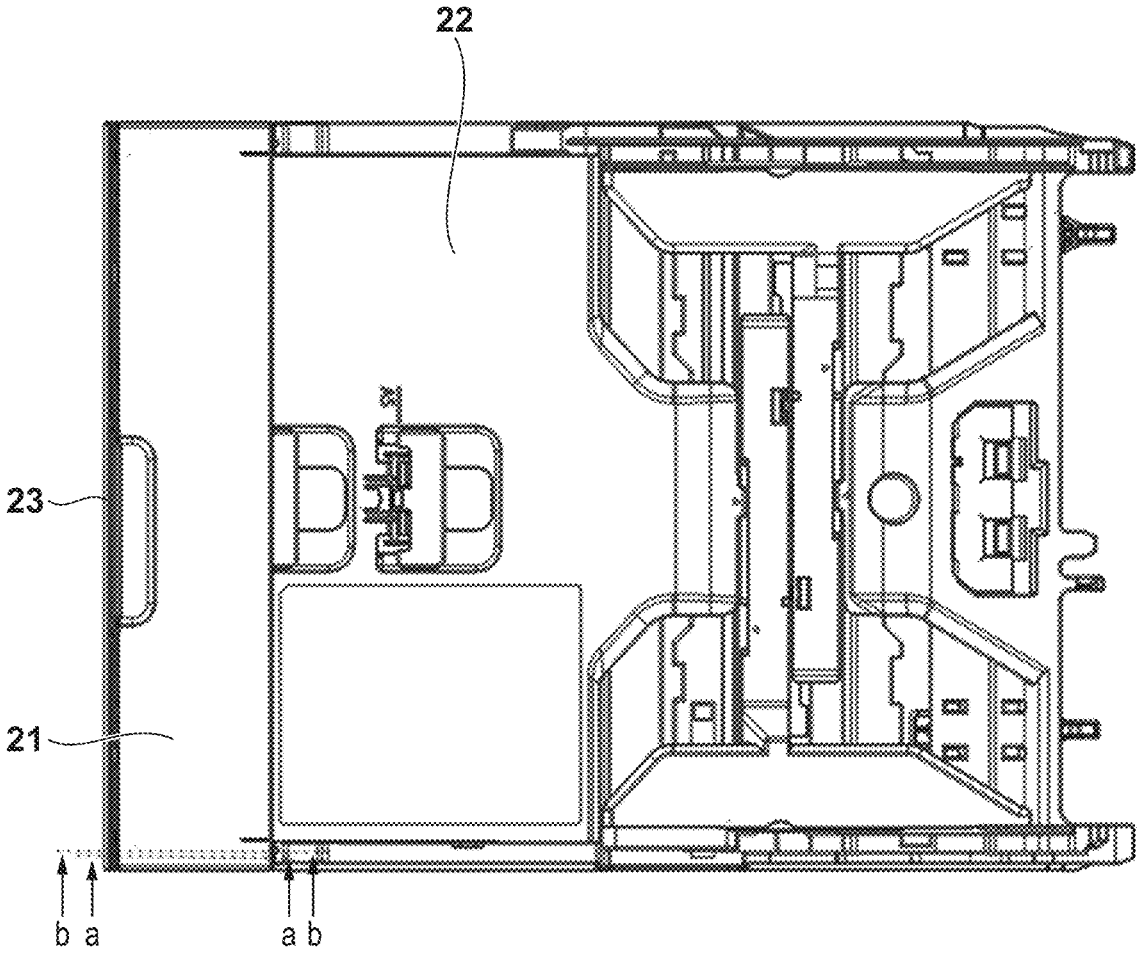
FIG. 6 is a top view of the sheet feed cassette and cassette cover.
Figure 7A:
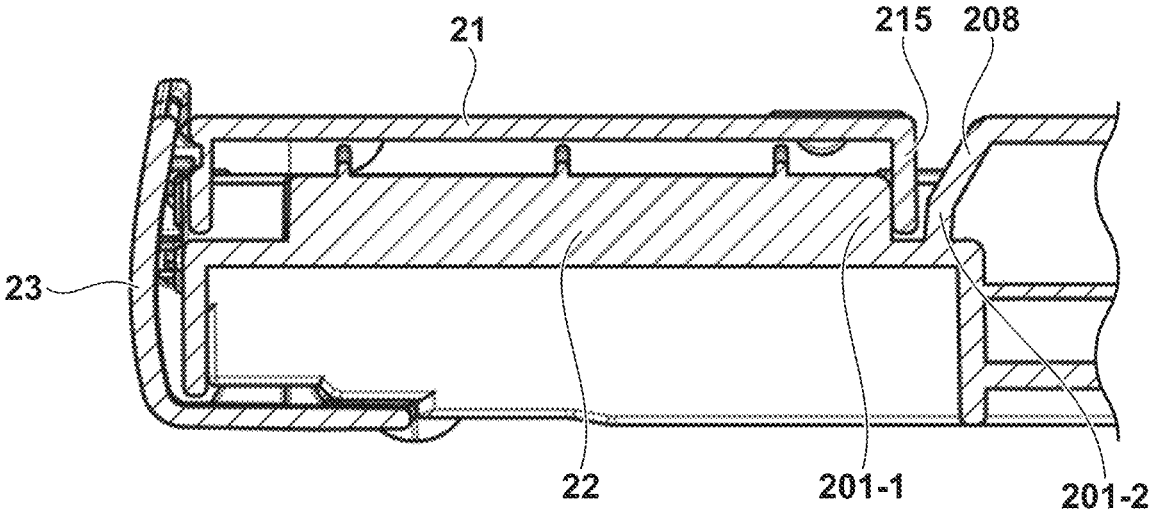
FIGS. 7A and 7B are an a-a cross-sectional view and a b-b cross-sectional view of FIG. 6.
Figure 7B:
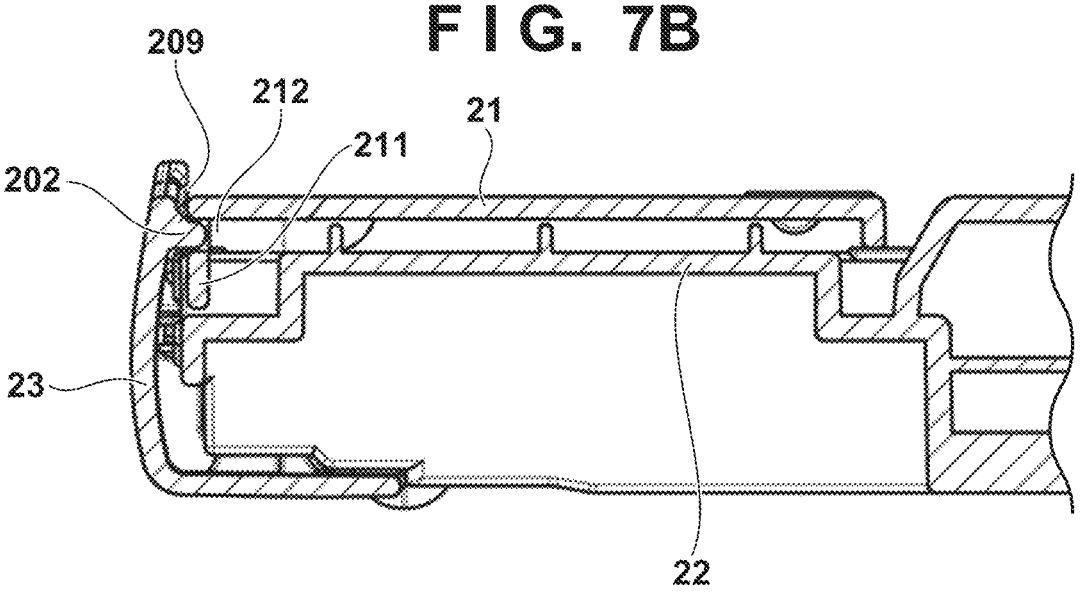
Figure 8:
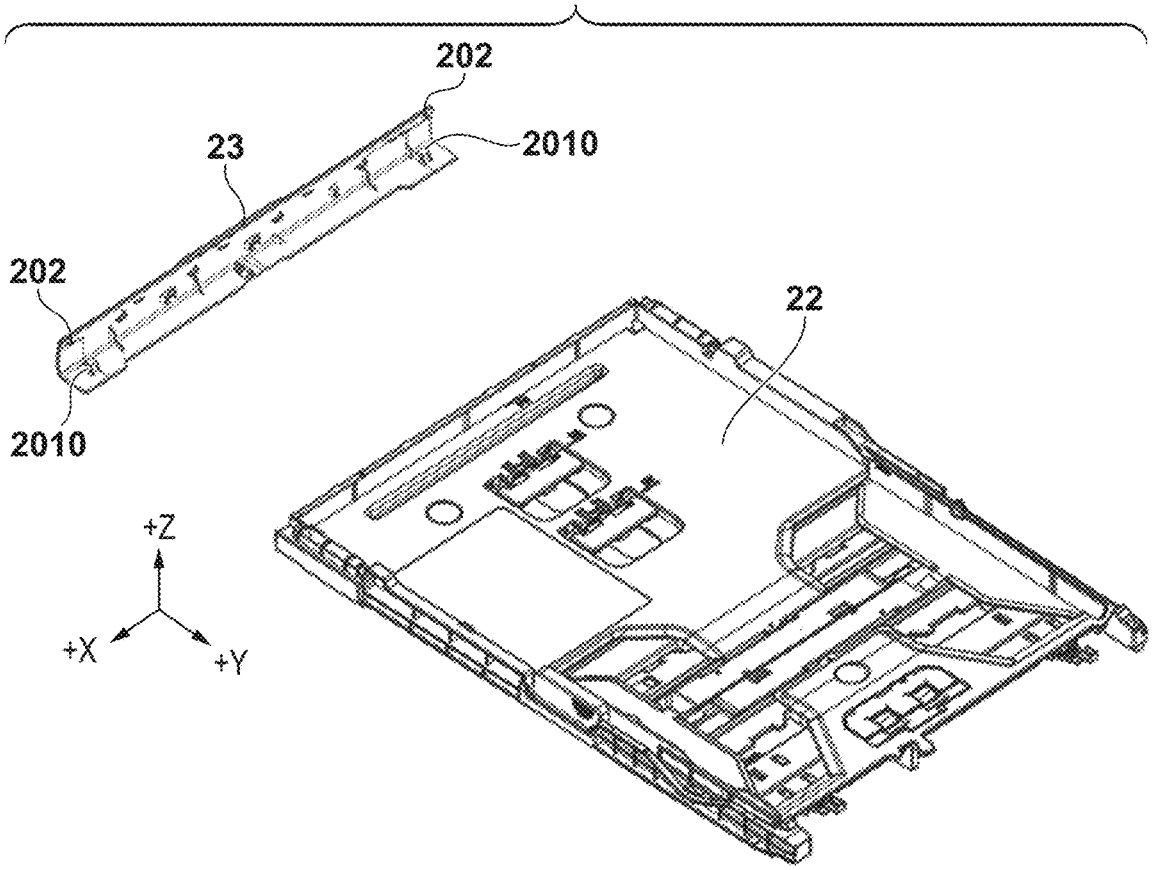
FIG. 8 is a perspective view in a state in which a cassette design cover is removed from a cassette body portion.

FIGS. 4A and 4B are perspective views of the sheet feed cassette body 20, FIGS. 5A and 5B are perspective views of the cassette cover 21, and FIG. 6 is a top view of the sheet feed cassette 25. Also, FIGS. 7A and 7B are respectively an a-a cross-sectional view and a b-b cross-sectional view of FIG. 6. Furthermore, FIG. 8 is a perspective view in which the sheet feed cassette body 20 is separated into a cassette design cover 23 and a cassette body portion 22.

As shown in FIGS. 5A and 5B, a periphery protrusion portion 211 that is arranged along peripheral edges of the cassette cover 21 on a back face side thereof and protrudes therefrom is formed in the peripheral edges of the cassette cover 21. The periphery protrusion portion 211 is constituted by a front side periphery protrusion portion 211-1 on one side, a back side periphery protrusion portion 211-2 on the other side, and other portions, and the front side periphery protrusion portion 211-1 and the back side periphery protrusion portion 211-2 are respectively formed in sides of the cassette cover 21 that oppose to each other. An opening forming portion 214 in which an opening portion 212 is formed is provided in each of both end portions of the front side periphery protrusion portion 211-1 (a plurality of opening forming portions 214 are provided), and each opening forming portion 214 is formed to have a height that is larger than that of the other portions of the front side periphery protrusion portion 211-1. A position regulating portion 215 is provided in each of both end portions of the back side periphery protrusion portion 211-2, and each position regulating portion 215 is formed to have a height that is larger than that of the other portions of the back side periphery protrusion portion 211-2. Because the opening portion 212 needs to be provided inside each opening forming portion 214, the widths of the opening forming portion 214 and the position regulating portion 215, in a transverse direction (X direction) of the ink jet printing apparatus 10, are in the relationship "width of the opening forming portion 214>width of position regulating portion 215". Note that, here, the opening portion 212, which is a hole, is provided in the opening forming portion 214, but the configuration may be such that a recess-shaped portion for receiving (causing to advance) a later-described projection-shaped portion 202 is provided, instead of the opening portion 212.

Also, as shown in FIGS. 4A and 4B, the sheet feed cassette body 20 is provided with front side position regulating portions 201-1 and back side position regulating portions 201-2 each including a tilting portion 208 in an upper portion, and furthermore, is provided with projection-shaped portions 202 that project toward the front side periphery protrusion portion 211-1 of the cassette cover 21. A tilting shape 209 is formed on an upper face of each projection-shaped portion 202. Note that the projection-shaped portions 202 are formed in the cassette design cover 23.

When the cassette cover 21 is attached to the sheet feed cassette body 20, the position regulating portions 215 of the cassette cover 21 are inserted into gaps each formed by the front side position regulating portion 201-1 and the back side position regulating portion 201-2. Here, the position regulating portions 215 are respectively guided by the tilting portions 208 formed in upper portions of the back side position regulating portions 201-2, and therefore the cassette cover 21 can be smoothly attached. Thereafter, the cassette design cover 23 of the sheet feed cassette body 20 elastically deforms, and the projection-shaped portions 202 enter the respective opening portions 212, and as a result, the cassette cover 21 is retained by the sheet feed cassette body 20.

Because the tilting shapes 209 are formed on the upper faces of the respective projection-shaped portions 202, when the cassette design cover 23 is elastically deformed by the cassette cover 21, the cassette cover 21 can be set without being caught. Regarding the height (length in the +Y direction) of the projection-shaped portion 202, if the height is too large, the force needed to attach the cassette cover 21 becomes large. Therefore, the height of the projection-shaped portion 202 is set such that the overlap amount between the projection-shaped portion 202 and the opening portion 212 in the Y direction is a smallest amount needed when the looseness, in the Y direction, of the cassette cover 21 in a state of being attached to the sheet feed cassette body 20 and variations in size of the components are taken into consideration.

The cassette cover 21 is a component that is gripped by a user for attachment, and therefore the risk that the user will drop it on a floor or the like is higher than that of the sheet feed cassette body 20. However, as a result of adopting the structure described above, the cassette cover 21 can be positioned and retained without providing therein a special protrusion for positioning and retaining the cover, and therefore the risk of damaging the cassette cover 21 can be suppressed.

The sheet feed cassette body 20 is constituted by the above-described cassette design cover 23 that constitutes a product exterior face (product front face) and the cassette body portion 22 for housing sheets, and the projection-shaped portion 202 is integrally formed with the cassette design cover 23. As a result of adopting such a structure, the positioning mechanism and retaining mechanism of the cassette cover 21 can be realized with a space saving and simple structure.

The cassette design cover 23 is provided with fixing claws 2010 on a face thereof opposing the bottom face of the ink jet printing apparatus 10, and is fixed to the cassette body portion 22 by the fixing claws 2010, the space thereabove being open. Therefore, when the cassette cover 21 is attached to the sheet feed cassette body 20, the portions in which the projection-shaped portions 202 of the cassette design cover 23 are provided each easily elastically deform as a whole. As a result, when the cassette cover 21 is attached to the sheet feed cassette body 20, smooth attachment can be realized.

Also, the cassette cover 21 may be formed by a transparent or semitransparent member in order to secure visibility of housed sheets (paper). In this case as well, as a result of adopting the configuration described above, the cassette cover 21 need not be provided with a special protrusion for positioning and retaining the cover, and therefore the exterior appearance is not damaged. That is, the visibility of sheets housed in the sheet feed cassette body 20 can be secured while maintaining the exterior appearance quality of the cassette cover 21.

The projection-shaped portions 202 enter the opening portions 212, of the front side periphery protrusion portion 211-1 of the cassette cover 21, from the outside of the cassette cover 21. The cassette cover 21 is provided with a user gripping portion 213 for improving operability of attachment and detachment thereof. Also, the user gripping portion 213 is arranged in the back side periphery protrusion portion 211-2 (the other side), which is on an opposite side of the front side periphery protrusion portion 211-1 (one side) provided with the opening portions 212.

As a result of adopting such a configuration, when the cassette cover 21 is set to the sheet feed cassette body 20 from the user gripping portion 213 side, the cassette cover 21 can be attached by utilizing elastic deformation of the cassette design cover 23. However, when a normal operation is performed, the user sets the cassette cover 21 to the sheet feed cassette body 20 from the opening portion 212 side, when attaching the cassette cover 21 to the sheet feed cassette body 20. Therefore, the cassette cover 21 can be smoothly attached by merely placing it without the cassette design cover 23 being elastically deformed.

As described above, in the embodiment described above, in a cassette cover that is attached on an upper face of the sheet feed cassette and can be removed by a user, the positioning of the cassette cover relative to the sheet feed cassette is performed by only the cassette cover periphery protrusion portion. Also, the retaining of the cassette cover is performed by providing a protrusion, in the sheet feed cassette, that protrudes toward the peripheral edge portion. Accordingly, the cassette can be positioned and retained without providing a protrusion in the cassette cover, and as a result, the risk that the cassette cover will be damaged when dropped can be suppressed.

Figure 9:
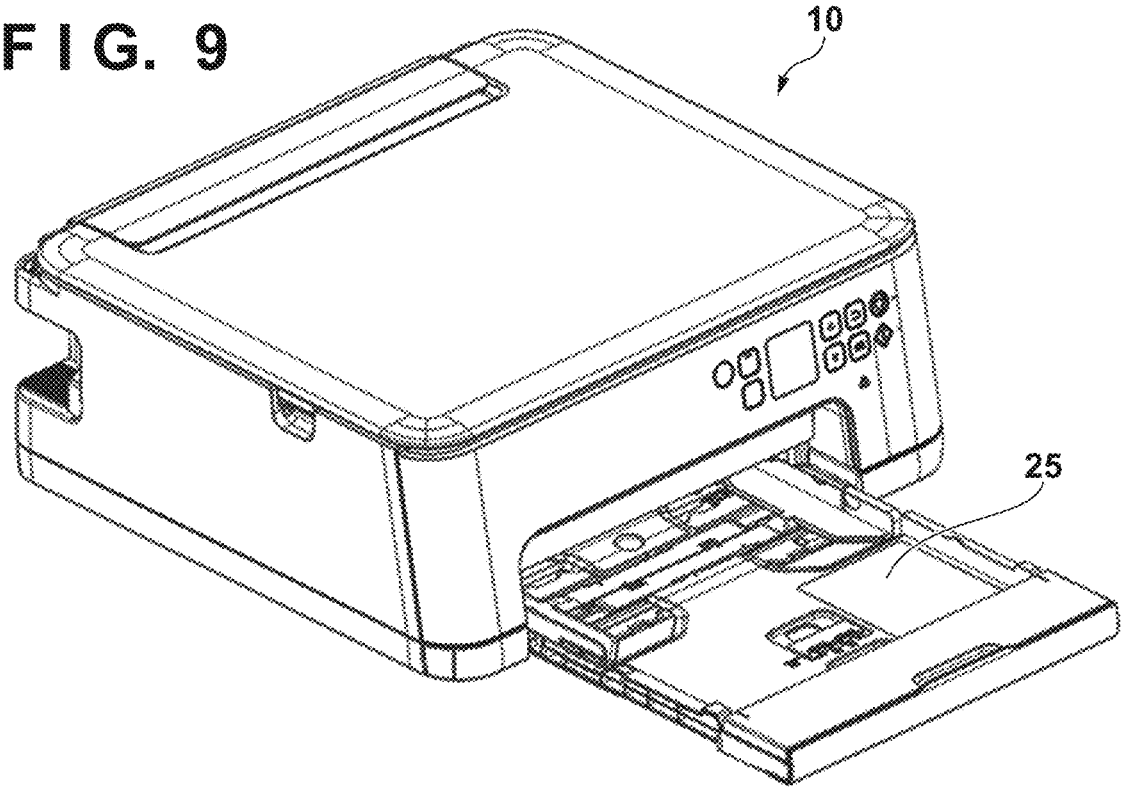
FIG. 9 is a perspective view illustrating a state in which the sheet feed cassette is drawn out.
Figure 10:
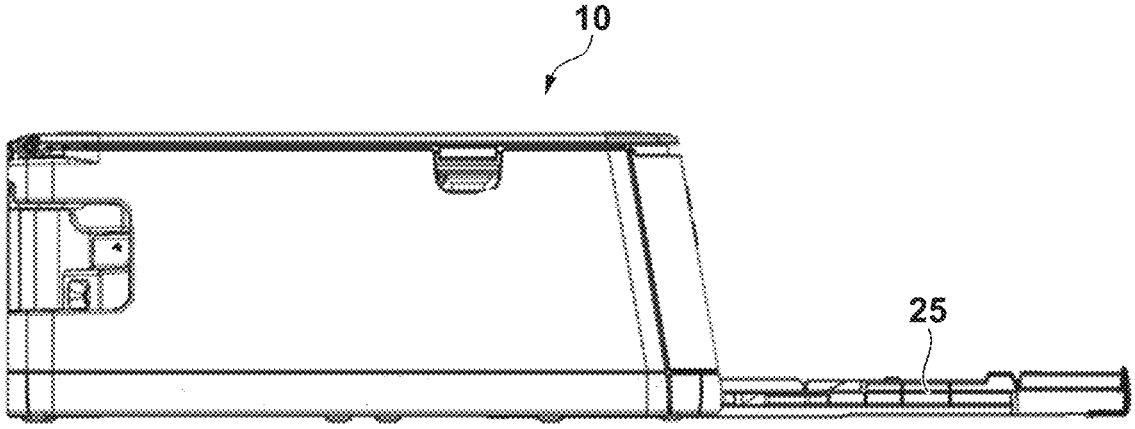
FIG. 10 is a side view illustrating a state in which the sheet feed cassette is drawn out.
Figure 11:
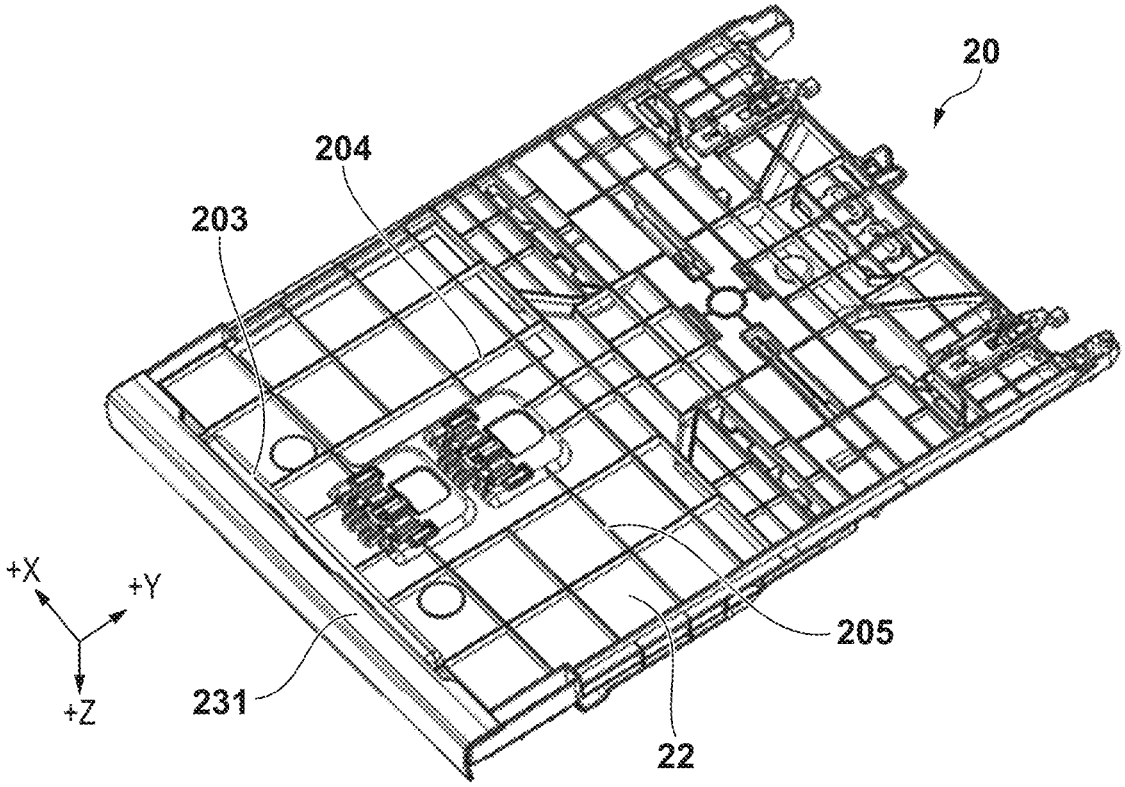
FIG. 11 is a perspective view illustrating the sheet feed cassette viewed from a bottom face side.
Figure 12:
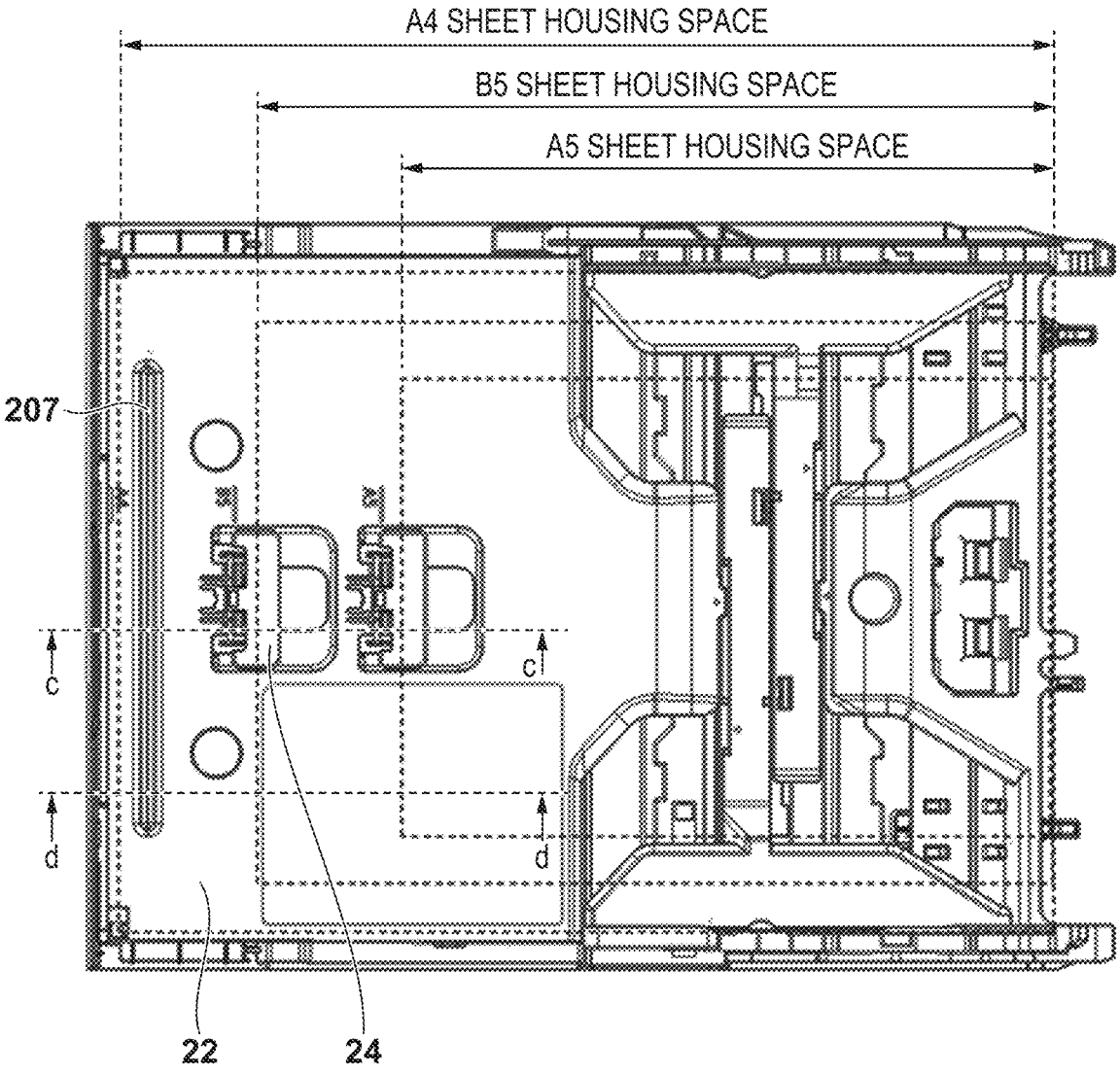
FIG. 12 is a top view of the sheet feed cassette.
Figure 13A:
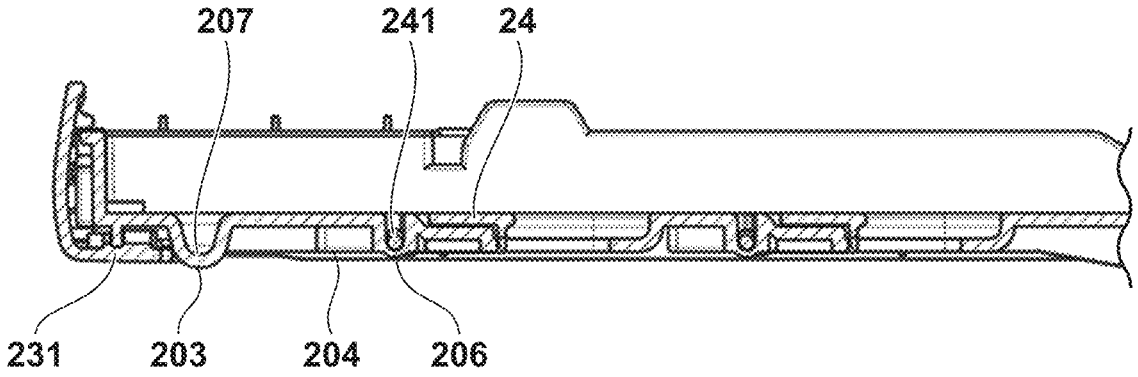
FIGS. 13A and 13B are a c-c cross-sectional view and a d-d cross-sectional view of FIG. 12.
Figure 13B:
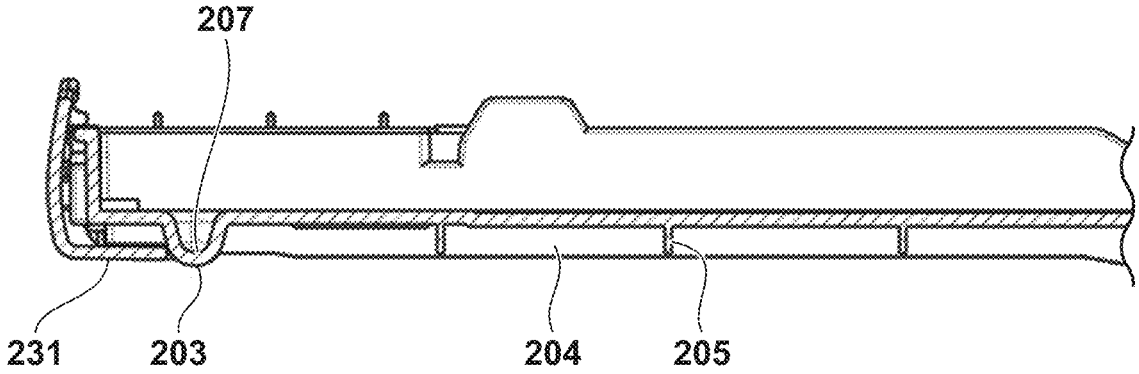
Figure 14:
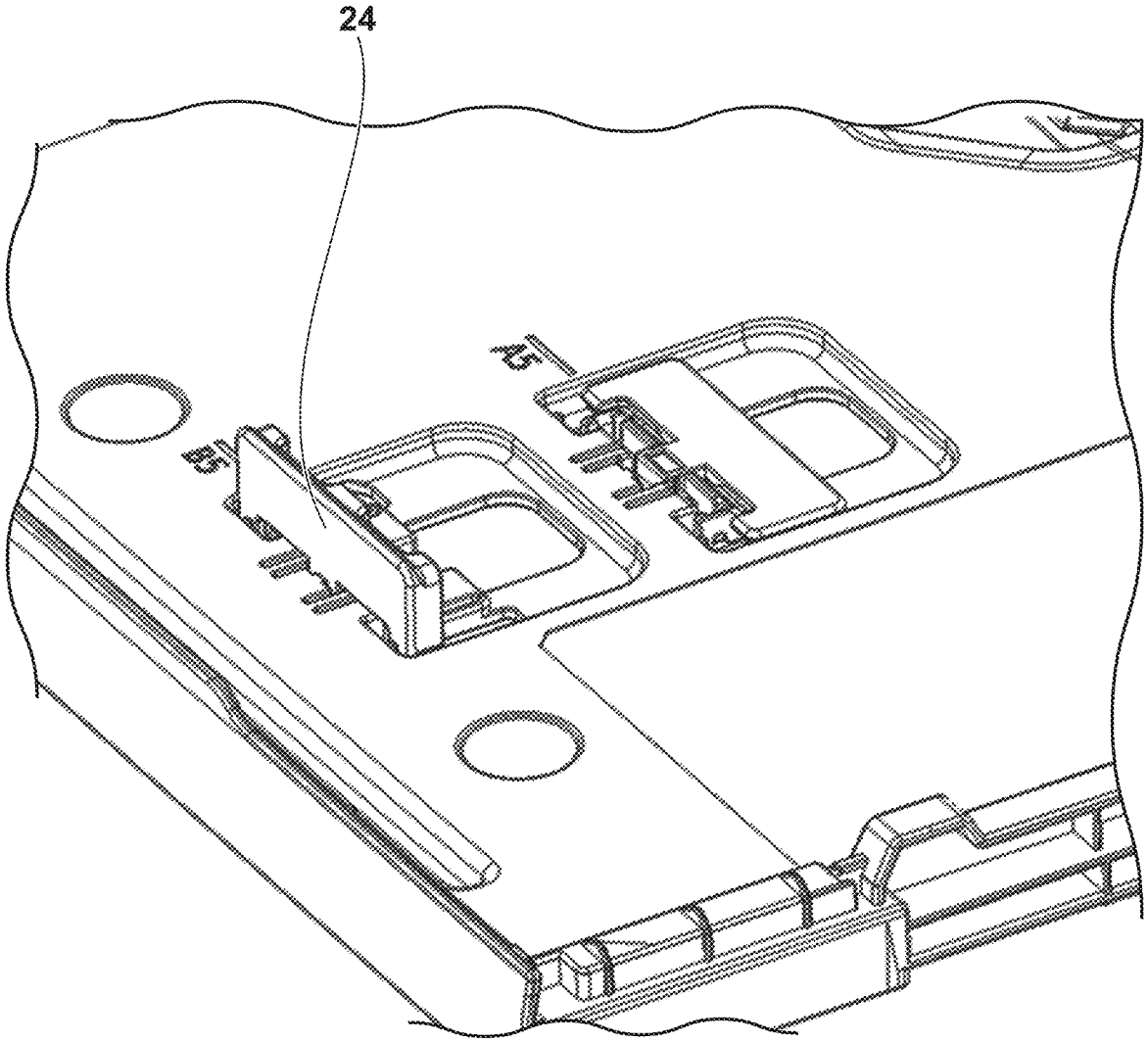
FIG. 14 is an enlarged perspective view illustrating a sheet guide member of the sheet feed cassette.

FIGS. 9 and 10 are respectively a perspective view and a side view that illustrate the state of drawing out the sheet feed cassette 25 from the ink jet printing apparatus 10. FIG. 11 is a perspective view of the sheet feed cassette body 20 viewed from the bottom face side. FIG. 12 is a top view of the sheet feed cassette body 20. FIGS. 13A and 13B are respectively a cross-sectional view along arrows c-c and a cross-sectional view along arrows d-d in FIG. 12. FIG. 14 is a perspective view illustrating the sheet guide member 24 in standing state.

There are cases where, in order to reduce the apparatus size, in the ink jet printing apparatus 10, a structure is adopted in which the sheet feed cassette body 20 is close to the installation floor surface of the ink jet printing apparatus 10. In such a structure, it is possible that, when the sheet feed cassette body 20 is drawn out from the ink jet printing apparatus 10 in the —Y direction in order to perform sheet refilling and replacing work, the bottom face of the sheet feed cassette body 20 comes into contact with and rubs against the installation floor surface.

Therefore, in the present embodiment, a protruded portion 203 that projects toward the installation floor surface is provided on the bottom face of the sheet feed cassette body 20. As shown in FIGS. 13A and 13B, in the protruded portion 203, the portion that comes into contact with the installation floor surface has an R shape. The heights, in a —Z direction, of a bottom face portion 231 of the cassette design cover 23 and the apex of the protruded portion 203 are in the relationship "bottom face portion 231<protruded portion 203". Also, a cut-out portion is provided in the bottom face portion 231 of the cassette design cover 23 in an area separate from the R shape.

As a result of adopting such a structure, when the sheet feed cassette body 20 is attached and detached, even in a case where the operation is performed such that the sheet feed cassette 21 rubs against the installation floor surface of the ink jet printing apparatus 10, the R shape of the protruded portion 203 comes into contact with the installation floor surface. Therefore, generation of abnormal noise and damage of the installation floor surface can be prevented, when the sheet feed cassette body 20 is attached and detached.

The width of the protruded portion 203 in a direction (X direction) orthogonal to the attaching and detaching direction (Y direction) of the sheet feed cassette body 20 is larger than the width thereof in the attaching and detaching direction. Therefore, the area of contact between the installation floor surface and the protruded portion 203 can be increased, and the pressure applied to the installation floor surface can be distributed, compared with a case where a thin-shaped portion such as a rib is provided. Accordingly, the risk of damaging the installation floor surface can be reduced.

The protruded portion 203 is integrally formed with the cassette body portion 22, and the portion of the protruded portion 203 on a back face side is a recess-shaped portion 207. The protruded portion 203 is provided at a position that overlaps the range in which sheets of a maximum size (A4) that can be set in the sheet feed cassette body 20 are set, and does not overlap the range in which sheets of the size (B5, A5) other than the maximum size are set. Also, the width of the protruded portion 203 in the direction (X direction) orthogonal to the attaching and detaching direction of the sheet feed cassette body 20 is smaller than the width of sheets of maximum size (A4) that can be set in the sheet feed cassette body 20. Also, the protruded portion 203 is provided inside the range (within the range) in which sheets of maximum size (A4) are set, in the direction orthogonal to the attaching and detaching direction of the sheet feed cassette body 20.

As a result of adopting such a structure, the recess-shaped portion 207 is arranged at a position outside the range in which sheets of small size (B5, A5) are set, and therefore small size sheets can be prevented from being caught in the recess-shaped portion 207 when being set in the sheet feed cassette body 20. Also, when sheets of maximum size (A4) are set, the sheet end passes outside the recess-shaped portion 207, and therefore, sheet are unlikely to be caught in the recess-shaped portion 207. Therefore, settability of sheets can be improved while preventing the size of the sheet feed cassette from increasing, and therefore the occurrence of abnormal noise due to floor rubbing can be prevented.

In order to increase the rigidness of the sheet feed cassette body 20, a rib is commonly provided on a back face of the sheet feed cassette body 20. In the present embodiment, a longitudinal rib 204 that is in parallel with the attaching and detaching direction (Y direction) of the sheet feed cassette body 20 and a transverse rib 205 that is in parallel with the direction (X direction) orthogonal to the attaching and detaching direction of the sheet feed cassette body 20 are provided. The height of the longitudinal rib 204 in the —Z direction is set to be smaller than the height of the protruded portion 203. Also, the height of the transverse rib 205 in the —Z direction is set to be smaller than the height of the longitudinal rib 204. The transverse rib 205 in a direction (X direction) orthogonal to the attaching and detaching direction of the sheet feed cassette body 20 is likely to cause abnormal noise due to vibration, if the transverse rib 205 rubs against the installation floor surface when the sheet feed cassette body 20 is attached and detached. Therefore, as a result of adopting such a structure, the transverse rib 205 can be prevented from coming into contact with the installation floor surface, and the occurrence of abnormal noise due to vibration of the transverse rib 205 can be prevented.

A sheet guide member 24 for regulating the sheet position is attached to the sheet feed cassette body 20 so as to pivot about a shaft portion 241, and the sheet end position can be regulated by causing the sheet guide member 24 to stand up. An attachment shape portion 206 for attaching the sheet guide member 24 is integrally formed with the cassette body portion 22, and is formed in an overlapping range with the longitudinal rib in the attaching and detaching direction (Y direction) of the sheet feed cassette. Also, the height of the attachment shape portion 206 in the —Z direction is set to be smaller than the height of the longitudinal rib 204.

According to such a structure, the attachment shape portion 206 will not rub against the installation floor surface, and therefore the sheet feed cassette body 20 can be prevented from being caught by the installation floor surface when the sheet feed cassette body 20 is attached and detached.

As described above, according to the embodiment described above, as a result of adopting a configuration in which the R shape portion having a protruded shape provided on the bottom face of the sheet housing portion slides on the installation floor surface when the sheet feed cassette is attached and detached, occurrence of abnormal noise at the time of attachment and detachment can be prevented.

The present invention is not limited to the above embodiments and various changes and modifications can be made within the spirit and scope of the present invention. Therefore, to apprise the public of the scope of the present invention, the following claims are made.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-133673, filed Aug. 18, 2021, which is hereby incorporated by reference herein in its entirety.

What is claimed is:

1. A cassette comprising:

a sheet housing portion that has an opening in an upper face and houses sheets;

a cassette cover that can be attached and detached and covers at least a portion of the opening;

a first protruding portion that is provided in one edge portion of the cassette cover and protrudes toward a bottom face of the sheet housing portion; and a second protruding portion that is provided in the other edge portion of the cassette cover and opposes the first protruding portion, wherein the sheet housing portion includes a projection-shaped portion that protrudes toward the first protruding portion and a position regulating portion that has a gap into which the second protruding portion enters, and the first protruding portion is provided with a receiving portion into which the projection-shaped portion enters.

2. The cassette according to claim 1, wherein a plurality of the receiving portions are provided in the first protruding portion.

3. The cassette according to claim 1, wherein the portion in which the projection-shaped portion of the sheet housing portion is arranged is a design cover that forms a portion of the bottom face of the sheet housing portion and a front face of the sheet housing portion.

4. The cassette according to claim 3, wherein a protruded portion having an R shape is formed on the bottom face of the sheet housing portion, and an apex of the protruded portion is lower than a bottom face formed by the design cover.

5. The cassette according to claim 4, wherein the width of the protruded portion in a direction orthogonal to an attaching and detaching direction of the cassette is larger than the width in the attaching and detaching direction of the cassette.

6. The cassette according to claim 5, wherein the protruded portion is integrally formed with the sheet housing portion and is provided at a position that overlaps a range in which sheets of maximum size that can be set in the sheet housing portion are stacked and does not overlap a range in which sheets of size other than the maximum size are stacked.

7. The cassette according to claim 6, wherein the width of the protruded portion in a direction orthogonal to the attaching and detaching direction is smaller than the width of sheets of maximum size that are housed in the sheet housing portion, and the protruded portion is provided inside the width range of sheets of maximum size in the direction orthogonal to the attaching and detaching direction.

8. The cassette according to claim 4, wherein a longitudinal rib that is arranged in parallel to an attaching and detaching direction of the cassette and a transverse rib that is arranged in a direction orthogonal to the attaching and detaching direction are provided on a back face of the sheet housing portion, and the height of the longitudinal rib is smaller than the height of the protruded portion, and the height of the transverse rib is smaller than the height of the longitudinal rib.

9. The cassette according to claim 8, wherein the sheet housing portion is provided with a sheet guide member for regulating the position of sheets, and an attachment shape for attaching the sheet guide member is formed in a range, in the attaching and detaching direction, that overlaps the longitudinal rib, and the height of the attachment shape is smaller than the height of the longitudinal rib.

10. The cassette according to claim 1, wherein a tilting portion for guiding approach of the first protruding portion is formed in an upper portion of the position regulating portion.

11. The cassette according to claim 1, wherein a tilting shape is formed in an upper portion of the projection-shaped portion.

12. The cassette according to claim 1, wherein the projection-shaped portion enters the receiving portion, of the first protruding portion of the cassette cover, from the outside of the cassette cover.

13. The cassette according to claim 1, wherein a gripping portion to be gripped by a user is provided in the cassette cover on the first protruding portion side.

14. The cassette according to claim 1, wherein the cassette cover is formed by a transparent or semitransparent member.

15. A printing apparatus to which the cassette according to claim 1 is attachable.

* * * * *